United States Patent [19]

Sorli

[11] Patent Number: 4,893,144

[45] Date of Patent: Jan. 9, 1990

[54] CONTINUOUS WEB FORM INSTANT PHOTOGRAPHIC MATERIALS AND METHOD FOR PROCESSING THE SAME

[75] Inventor: Duncan C. Sorli, Chelmsford, Mass.

[73] Assignee: Polaroid Corporation, Cambridge, Mass.

[21] Appl. No.: 313,162

[22] Filed: Feb. 21, 1989

[51] Int. Cl.[4] ..... G03D 5/02

[52] U.S. Cl. ..... 354/304; 354/86; 430/208; 430/209

[58] Field of Search ..... 354/85, 86, 87, 304, 354/84; 430/208, 209, 210, 497, 498, 499

[56] References Cited

U.S. PATENT DOCUMENTS

| | | | |
|---|---|---|---|
| 2,644,755 | 7/1953 | Wolff et al. | 430/209 |
| 3,635,139 | 1/1972 | Gulte | 354/304 |
| 3,648,584 | 3/1972 | Eacock | 354/84 |
| 3,776,732 | 12/1973 | Frost et al. | 430/209 |
| 3,854,812 | 12/1974 | Sorli | 354/312 |
| 4,162,834 | 7/1979 | MacLean | 354/86 |
| 4,519,689 | 5/1985 | Kinsman et al. | 354/304 |
| 4,735,886 | 4/1988 | Oshikoshi et al. | 430/208 |

*Primary Examiner*—A. A. Mathews

*Attorney, Agent, or Firm*—Alfred E. Corrigan

[57] ABSTRACT

A rapid access processing method for processing and delivering successive image frames on a continuous carrier web in a manner so that processing liquid spread over the area of each image frame on the carrier web is confined essentially to the image frame to leave areas of the carrier web uncovered by the image frame free of processing liquid. The carrier web also supports a pod of processing liquid along a leading edge of each image frame as well as a trap along a trailing edge of each image frame. The spent pods and wet traps are transferred from the carrier web, after processing, to an image bearing web from which image media was transferred to the image frames during processing.

11 Claims, 4 Drawing Sheets

FIG 3A
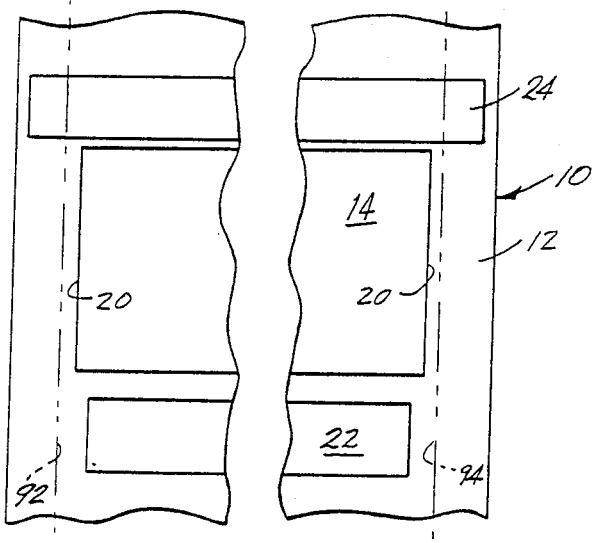
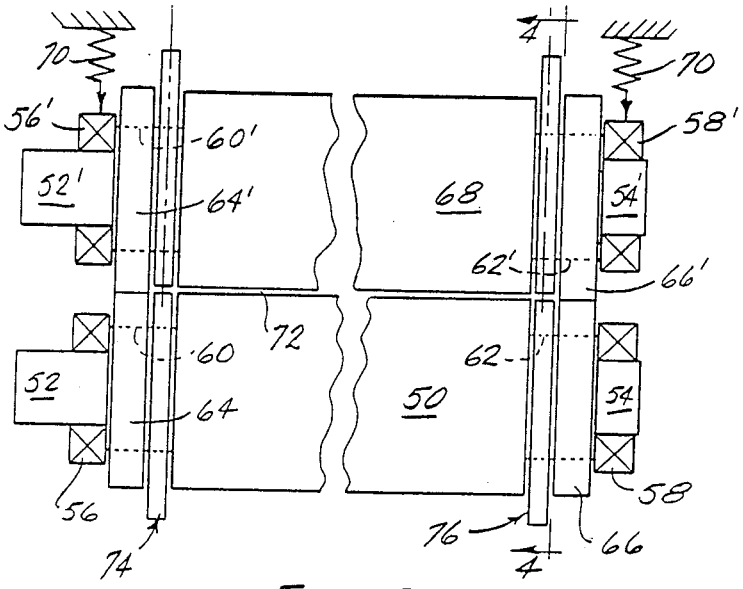
FIG 3B

CONTINUOUS WEB FORM INSTANT PHOTOGRAPHIC MATERIALS AND METHOD FOR PROCESSING THE SAME

BACKGROUND OF THE INVENTION

1. Field of the Invention

This invention relates to photographic film and to a method for rapid access processing of continuous web form or web carried instant of self-developing photographic films.

2. Description of the Prior Art

The term "rapid access", as used herein and in the appended claims, is intended to delineate a type of photographic film or film processing which is capable of providing an image on a substrate which has been exposed directly to light defining the image or to which an image is transferred from another image or image facsimile bearing media, by application of a processing liquid layer over the area of the image to be provided. The most common form of rapid access film processing is the diffusion transfer process used in the field of instant photography, and in which a processing liquid is spread over the surface of a sheet or web carried exposed photosensitive emulsion so that the unexposed grains of silver halide in the emulsion layer are transferred to a positive image-receiving layer or layer interface. The process has been used extensively for many years to provide positive photographic prints in which the transfer of unexposed grains from the emulsion layer on a negative sheet, for example, is to image-receiving layer either on a separate positive sheet or incorporated in a photochemical system contained between coextensive opaque and transparent sheets. More recently, positive image transparencies have been developed in which both the photosensitive emulsion layer and the image-receiving layer are carried on a single transparent web or sheet so that upon processing, the transfer occurs between the emulsion layer and the image-receiving layer. Other types of films are known, however, where exposed and unexposed grains or dyes in an emulsions are processed to provide an image without transfer.

Commonly assigned U.S. Pat. No. 4,519,689 discloses a method and apparatus for rapid access processing directed particularly to film systems in which only the final photographic product is delivered as a discrete sheet separated during the latter stages of processing from a carrier web on which it was supported for processing. All other spent components of the film system, such as spent processing liquid pods, the exposed and processed negative, as well as any residual processing liquid remaining about the edges of the final product, were left remaining on the carrier web wound onto a roll to be discarded. As a result, the finished sheet products were ejected from the processor in a clean and easily handled condition.

While the delivery of discrete photographic sheets by processing systems of the type disclosed in the aforementioed U.S. patent is preferred for many applications, in other applications, such as where it is desired to preserve the photographs in a particular sequence or order or to preserve grouping of the photographs at least for some determinate period of time after processing, it is preferred that the photographic products be delivered form the processor as sheets mounted on a carrier web or as separate image frames on a continuous web of positive photographic sheet material, for example. In this situation, a problem occurs as a result of processing liquid being spread beyond the side and trailing edges of either the carrier mounted sheet or of the image frame in a continuous single web. Such residual processing liquid is not only a source of contamination of the photographic product delivered form the processor, but is generally undesirable to the person who must handle the processed product to separate the finished photographs from the continuous carrier web either by peeling separation or by cutting. There is need, therefore, for a rapid accessing process and apparatus by which the product of same may be delivered in continuous form and free of processing liquid.

SUMMARY OF THE PRESENT INVENTION

In accordance with the present invention, an improved rapid access processing method is provided by which a processed photographic sheet product may be delivered in continuous web form without contamination by processing liquid used during processing.

The invention is practiced by feeding a continuous image-bearing web to bring image from areas thereon into superposed registration with image frames on a continuous image-receiving web. The image frames are preceded by rupturable pods of processing liquid releasably carried initially by the image-receiving web so that upon passage of both webs through a processing gap defined, for example, by a processing roller pair, the pod will be ruptured and the liquid therein spread uniformly throughout the area of the image frame now sandwiched between the two webs. During passage of the webs through the processing gap, lateral spread of the processing liquid beyond the side edges of the image frame is prevented by guide shoes engaging opposite sides of both webs in a position upstream from the rollers. Residual processing liquid passing the trailing end of the image frame is absorbed by a paper trap releasably secured to the image-receiving web.

After passing the processing roller pair to a dwell station where the two webs remain in superposed contact about the image frame for a predetermined imbibition period, the image-bearing web is trained about an idler roller to separate it from the image-receiving web. As a result of the tackiness of the processing liquid and the provision of an additional tacky adhesive on the processing liquid pod, the pod will be removed from the image-receiving web and secured to the image-bearing web. The trap at the trailing edge of the image frame will likewise be secured to the negative or image-bearing web and be removed from the image-receiving web for ultimate disposal with a roll of the image-bearing web. The image-receiving material passed from the processor may be configured either as a continuous carrier web from which a processed image frame sheet product may be peeled or as a continuous web of image-receiving material from which the image frames are cut. In either event, a portion of the image-receiving web lying outside of the image frames will be left clean of the processing liquid spread over the image frame during processing.

A principal object of the present invention, therefore, is the provision of an improved processing method by which an instant photographic product may be delivered after processing in continuous web form without contamination by residual processing liquid.

Another object of the invention is to provide a processed photographic sheet product which is delivered to a user substantially free of contamination by processing liquid used in the processing thereof.

Other objects and further scope of applicability of the present invention will become apparent from the detailed description to follow taken in conjunction with the accompanying drawings in which like parts are designated by like reference numerals.

BRIEF DESCRIPTION OF THE DRAWINGS

FIGS. 3A and 3B are respectively, a fragmented plan elevation of the image receiving web of FIG. 1 and an end elevation of a processing roller apparatus of the invention relating lateral dimensions of the apparatus to those of the image-receiving web;

DETAILED DESCRIPTION OF THE PREFERRED EMBODIMENT

Figure 1:
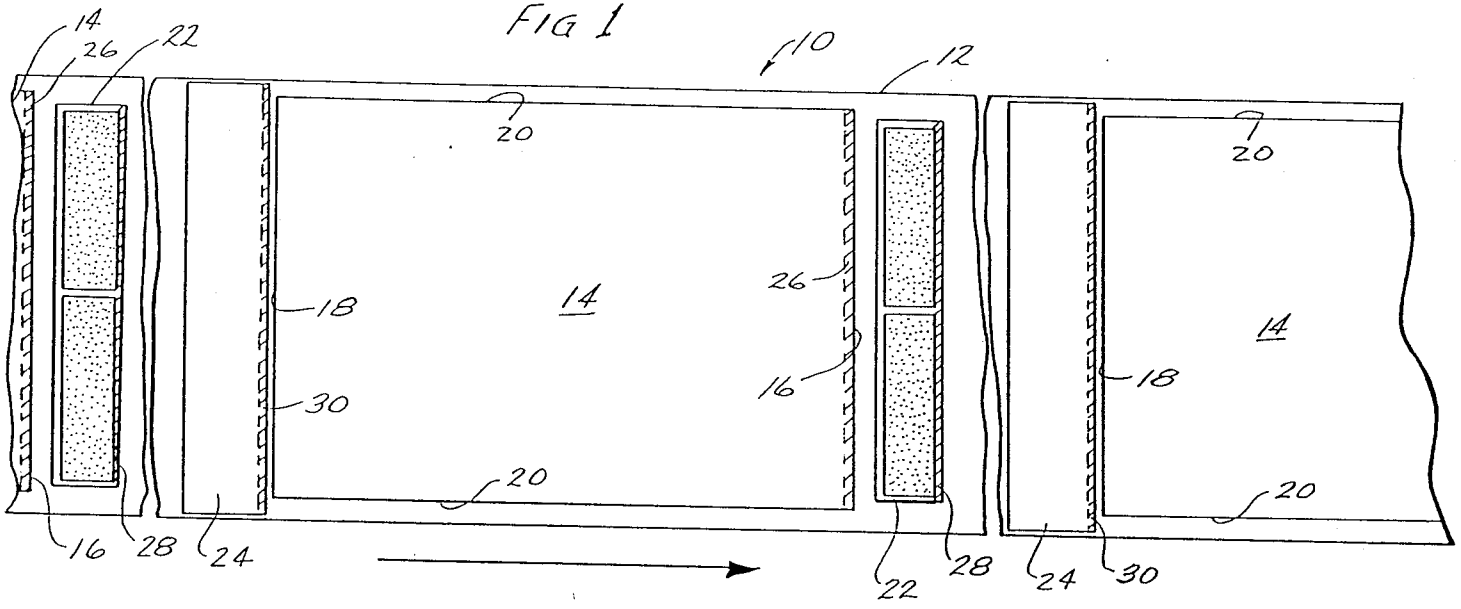
FIG. 1 is a fragmented plan view illustrating an image receiving web assembly in accordance with the present invention.

As shown in FIG. 1 of the drawings, an image-receiving web assembly adapted for use in the practice of the present invention is generally designated by the reference numeral 10. In the illustrated embodiment, the web assembly 10 includes a continuous carrier web 12 supporting on one surface thereof a plurality of longitudinally spaced image-receiving sheets 14, each having leading and trailing edges 16 and 18, respectively, and parallel opposite side edges 20. Positioned on the carrier web 12 near the leading edge 16 of each image-receiving sheet 14 is a rupturable processing liquid pod 22. Near the trailing edge 18 of each image-receiving sheet 14 is a generally rectangular processing liquid trap 24.

In the embodiment of the web assembly 10 shown in FIG. 1, each of the image-receiving sheets 14, pods 22 and traps 24 is releasably secured to the web 12 by adhesive compositions having selected adhesion strengths and to be described in more detail below. As may be seen in FIG. 1, however, the regions of such adhesive securement are delineated by cross-hatching and extend as narrow transverse stripes along the leading edges of the respective components secured to the web 12. Thus, each of the image-receiving sheets 14 is secured by a stripe 26 of adhesive along the leading edge 16 thereof. In similar fashion, the pods 22 and traps 24 are secured to the web 12 by stripes of adhesive 28 and 30 along the respective leading edges of these components. Also, the top surface of the pod 22 in the illustrated embodiment is provided with a pressure sensitive adhesive coating depicted by stippling in FIG. 1 of the drawings.

Figure 2:
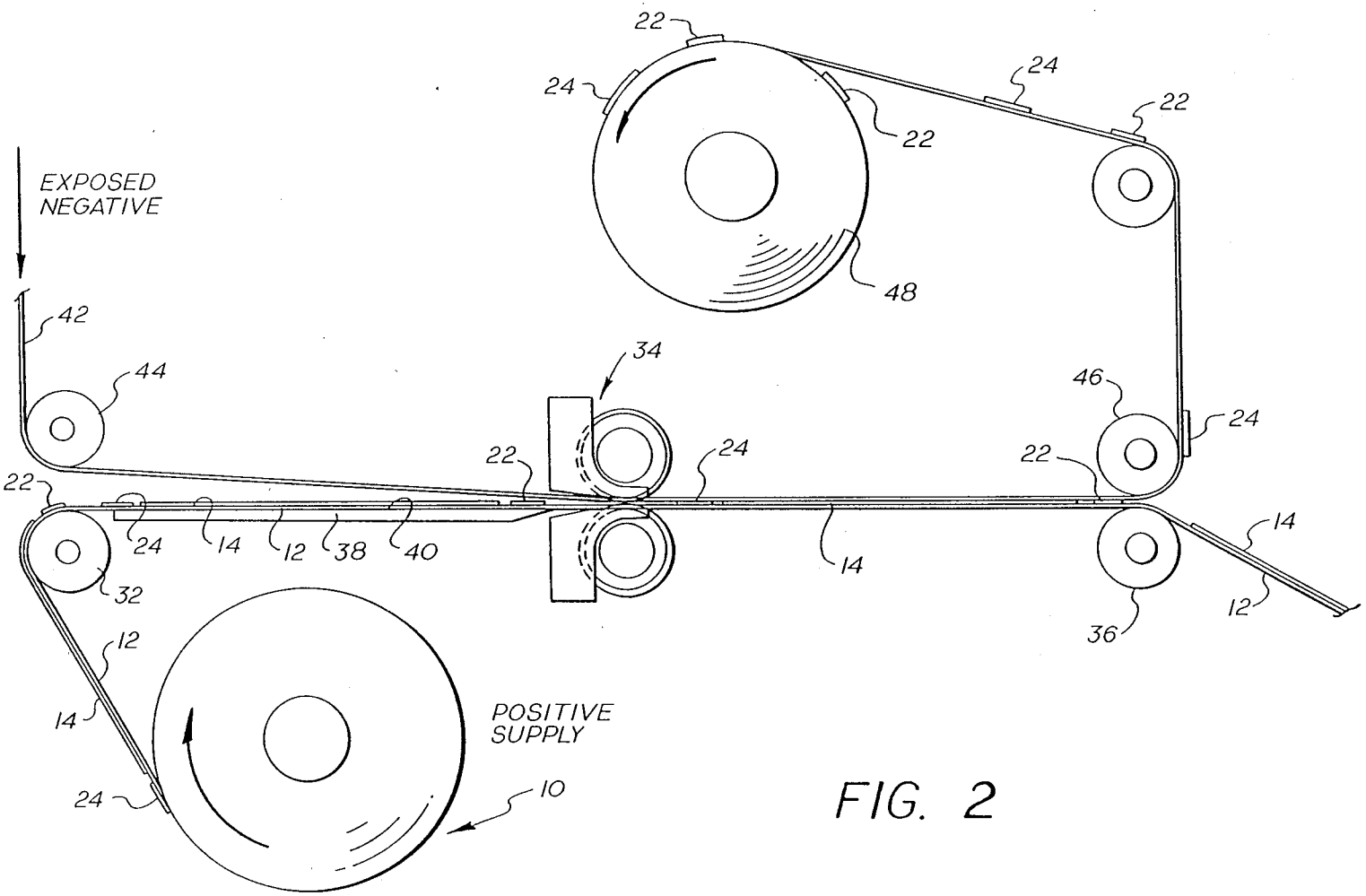
FIG. 2 is a largely schematic side elevation depicting the successive processing steps and apparatus of the invention.

A more complete understanding of the characteristics of the web assembly 10 will be had by reference to FIG. 2 of the drawings in which the processing operation of the invention is generally illustrated. As shown in FIG. 2, a rolled supply of the web assembly 10 is fed through successive linear runs defined respectively by an idler roller 32 and a processing roller pair 34, on the one hand, and by the roller pair 34 and another idler roller 36 located on the opposite side of the processor roller 34 from the idler 32, on the other hand. A platform 38 having a planar upper surface 40 oriented to be tangential with the idler roller 32 and the nip of the processing roller pair 34 is provided to assure retention of the web assembly 10 in the first of the two linear runs aforementioned.

As is well known in rapid access photographic film processing, the image to be received by each of the sheets 14 on the web assembly 10 may be supplied from an exposed negative, an exposed frame of which is registered with a frame of the image-receiving media, in this instance one of the sheets 14. Thus, a continuous image-bearing web 42 which in the illustrated embodiment, is a continuous negative photographic sheet, is passed through a run defined by an idler roller 44 and the nip of the pressure roller pair 34. Longitudinal registration of image frames on the exposed negative is accomplished by appropriate indexing means (not shown) in a manner known in the art. Also as is known in the art, passage of the superposed webs 12 and 42 through the processing roller pair 34 effects a rupture of the trailing end of the processing liquid pod 22 and the spread of the contents thereof uniformly between the image-bearing surface of the negative 42 and the uncovered surface of the sheets 14. After such passage through the processing roller pair 34, the two webs 42 and 12 are retained in a superimposed relationship for a duration of time or imbibition period, e.g., one minute. This is accomplished in the run extending between the processing roller pair 34 and the idler roller 36. Also in this context, an idler roller 46 together with the processing roller pair 34 supports the negative web 42 in overlying relationship with the web 12.

In accordance with the present invention, the processed image-receiving sheets 14, which after processing represent the final photographic product delivered by the processing operation, remain on the web 12 for subsequent removal therefrom as discrete photographic positives. The spent pods 22 and the straps 24, on the other hand, are attached to the used portion of the negative web 42 and wound with the web 42 into a roll 48 ultimately for disposal. Such transfers of the spent pods 22 and traps 24 from the web 12 to the web 42 and the releasable retention of the sheets 14 on web 12 are the result of relative strengths of the adhesives used to secure the sheet, pod, and trap components to the web 12 along the respective stripes 26, 28 and 30, as described above with reference to FIG. 1, and the adhesive forces tending to transfer such components to the web 42.

To achieve the described transfer of the spent pods 22 and traps 24 from the web 12, the adhesive used for the stripes 28 and 30 may be any of several commercially available pressure sensitive adhesives which exhibit a relatively high shear tack strength and a relatively low tear or tensile strength. Water base acrylic adhesives of the type available from Rohm & Haas of Philadelphia, Pennsylvania under the designation LC-67 are exemplary of such pressure sensitives which function very well to retain the pods 22 and traps 24 to the web 12 but enable release as a result of conditions causing adherence of the pods and traps to the negative web 42. In the case of the pod 22, the area of the negative web 42 contacted by a spent pod 22 will be dry as a result of the pod 22 being located ahead or upstream from the direction of processing liquid spread during a processing cycle. By providing a relatively large area of pressure sensitive adhesive over the top portion of the pods 22, the forces tending to adhere the pod 22 to the web 42 will be greater than the forces exerted by the adhesive along the relatively narrow stripe 28. The image-receiving sheet 14 stays with the web 12 because its adherence to the web 12 is greater than its bond to the web 42. Further, the adhesive of the top surface of the pod 22 should be of a material having a low affinity to the underside of the image-receiving web 12 so as to prevent adherence thereto when located on the supply roller, as shown in FIG. 2. For example, the rear surface of the image-receiving web 12 may have a coating of a plastic or paraphin material thereon.

The trap 24, in accordance with the present invention is in the form of a paper strip secured along the strip 30 to the web 12 using an adhesive of the type described. In this instance, adherence to the negative web 42 is a result of the residual processing liquid passing from the trailing edge of the sheet 14 on to the upper surface of the trap 24. The residual processing liquid operates as an adhesive which is relatively stronger than the adhesive used for the stripe 18 so that the wet trap will be picked up by the negative web 42 in the manner described. Also, by initially securing the traps 24 to the image-receiving web 12, process liquid is prevented from contacting the latter.

The removal of the spent pods 22 and the wet traps 24 from the web 12 as the processed sheets 14 are delivered on the web 12 assures removal of any residual processing liquid from the web 12 along the respective leading and trailing edges 16 and 18 of the sheets 14. Also, and as will be described in more detail below, provision is made for confining the processing liquid to the area laterally between the side edges 20 of the sheets 14. As a result, the delivered web 12 with the processed sheets 14 remaining thereon may be handled with ease and without contamination of the finished photographic product represented by the processed sheets 14 or of the hand and clothing of the person charged with handling the web.

Figure 4:
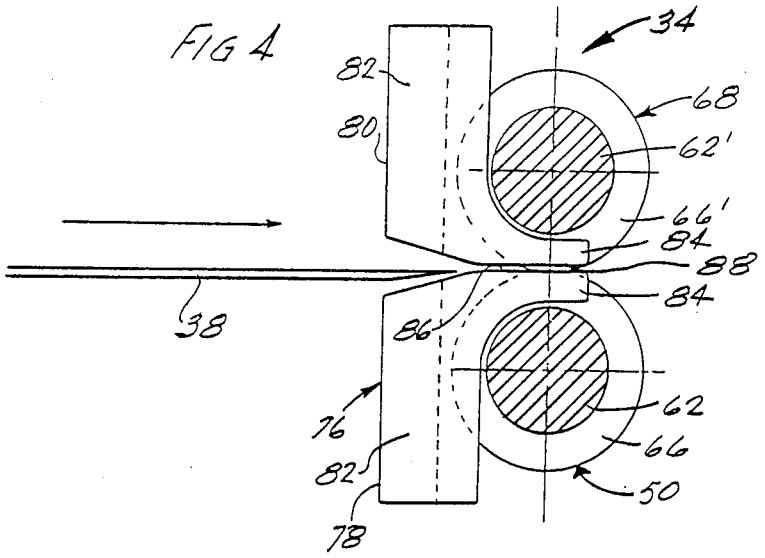
FIG. 4 is a side elevation of the processing roller apparatus.

The manner in which the lateral limits of processing liquid spread during passage of the webs 12 and 42 through the processing roller pair 34 may be understood by reference to FIGS. 3 and 4 of the drawings. In FIGS. 3B and 4, the organization of the processing roller pair 34 is shown to include a lower fixed roller 50 having stepped axial shaft extensions on opposite ends to define outboard trunnion shafts 52 and 54 journalled in support bearings 56 and 58, respectively, Inboard shaft portions 60 and 62 of diameters intermediate those of the roller 50 and those of the trunnion shafts 52 and 54 extend between opposite ends of the roller 50 and trunnion shafts 52 and 54. Press fit or otherwise secured at the outer ends of the inboard shaft extensions are spacing collars 64 and 66. The outer diameters of the collars 64 and 66 are slightly larger than the diameter of the roller 50 for reasons which will become apparent.

A biased movable roller 68 is the other of the processing roller pair and is substantially similar to the roller 50 that parts of the roller 68 corresponding to the parts described for the roller 50 may be designated by the same reference numerals primed. The bearings 56' and 58', however, are supported in practice for limited movement in the plane containing the axis of both rollers 50 and 58 and are biased by springs 70 so that the collars 64', 66', and 64, 66 are retained in rolling contact with one another under a predetermined force determined by the springs 70. Also, it will be noted that because the diameter of the collars is slightly larger than the diameter of the rollers 50 and 68, the rollers are initially spaced by a processing gap 72.

Between the collars 64,64' and 66,66' and opposite ends of the rollers 50,68 are positioned cooperating guide shoe pairs 74 and 76. As shown most clearly in FIG. 4, each such guide shoe pair 74,76 includes two guide shoes 78 and 80, each of which in turn includes a leg portion 82 and a foot portion 84. The shoes 78 and 80 are supported by the same structure that supports the roller bearings (not shown) so that mutually facing surfaces 86 and 88 on the respective foot portions of the guide shoes engage opposite sides of the superposed webs 12 and 42 as they pass through the gap 72 of the processing roller pair 34. In the context of web travel through the processing roller pair 34, the guide shoe pair 74 and 76 are located ahead of or upstream from the gap 72 so that as the processing liquid from the pods 22 is spread from the leading edge 16 to the trailing edge 18 of each sheet 14, lateral spread of the liquid will be restricted initially by the guide shoe pairs 74 and 76. In FIGS. 3A and 3B of the drawings, the lateral dimensioning of the processing roller pair 34 and the web 10 are depicted with phantom lines 92 and 94 representing the limits of lateral processing liquid spread as a result of operation of the guide shoe pairs 74 and 76.

It will be noted also from FIGS. 3A and 3B that the widths of the webs 12 and 42, which are the same, are related to the axial spacing of the collars 64,64' and 66,66' so that the respective collar pairs roll on marginal regions of the webs extending between opposite side edges 20 of the sheets 14 and opposite edges of both webs. As the webs 12 and 42 pass through the processing roller pair 34, therefore, the collars 62' and 66' supported by the biased roller 68 will be spaced from the collars 64 and 66 on the fixed roller 60 by the combined thickness of the webs 12 and 42. In this way, various thicknesses of the material used in the webs 12 and 42 will be accommodated while the dimension of the processing gap 72 relative to the sheets 14, for example, will remain constant as a result of the dimension of the gap 72 being fixed by the diametric relationship of the rollers 50 and 68 and the collars 64,64' and 66,66'. In addition, the dimension of the processing roller gap 72 may be selected for a particular processing apparatus simply by substituting collars of a specific diameter, which in relation to the diameter of the rollers 50 and 68, will determine the precise dimensions of the gap 72 desired for a particular type of film/web system.

Figure 5:
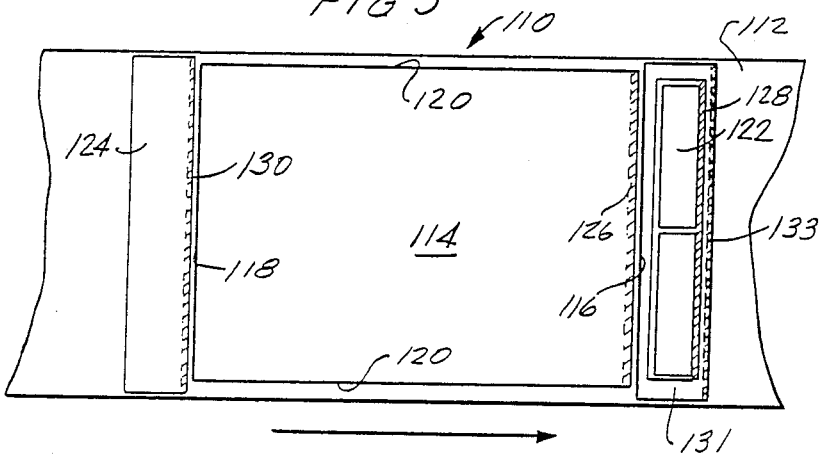
FIG. 5 is a fragmentary plan view similar to FIG. 1 but illustrating an alternative embodiment of the invention.

In FIG. 5 of the drawings, an alternative embodiment of a web assembly 110 is shown in which parts corresponding to parts previously identified by reference numeral in FIG. 1 are designated by the same reference numerals but in a "100" series. In the embodiment of FIG. 5, the pod 122 is secured permanently by a high strength adhesive to an apron 131 of paper which may be identical to the paper of the trap 24 and 124. The apron 131 extends outwardly and rearwardly of the pod 122 so that the trailing edge of the apron 131 is spaced closely to the leading edge 116 of the sheet 114. Also, the apron 131 is secured along its leading edge by an adhesive stripe 133 to the web 112. The adhesive used for the stripe 133 is preferably of the type described above and which will release easily from the web 112 as a result of a lifting force on the pod 122 and the apron 131 being provided by their affinity to the web 42 subsequent to the spreading of the processing liquid.

In the operation of the embodiment of FIG. 5, at least the trailing edges of the apron 131 will be wet by processing liquid passing from the pod 122 upon rupture thereof so that the wet portion of the apron will adhere to the image bearing sheet or negative 42 as the two webs are passed between the gap 72 of the processing roller pair 34 in the manner described above.

Thus it will be appreciated that as a result of the present invention, a highly effective method for rapid access processing of continuous web form photographic films is provided by which the principal objects among others are completely fulfilled. It will be appreciated by those skilled in the art and from the preceding description that modifications and/or changes may be made without departure from the present invention. For example, the webs 10 and 110 have been described as sheet carrying webs of paper of similar material with only the discrete sheets 14,114 having photographic characteristics, It is contemplated that the arrangement of pods 22,122 and traps 24,124 could be supported at the respective leading and trailing edges of a single image receiving frame on a continuous sheet of positive photographic material, for example. In this latter situation, the ultimate product would be cut from the web but th facility for so doing would be augmented by the retention of the processing liquid spread to the area of the image receiving frame. It is expressly intended, therefore, that the foregoing description and accompanying drawing illustrations are illustrative of preferred embodiments only, not limiting, and that the true spirit and scope of the present invention be determined by reference to the appended claims.

What is claimed:

1. The method for processing successive image receiving frames of rapid access instant photographic material on a continuous carrier web, said frames each having leading trailing and side edges and being spaced longitudinally on said carrier web, the width of each frame relative to the width of said carrier web providing marginal areas between opposite side edges of said frames and opposite side edges of said carrier web, said method comprising the steps of:

supplying a measured quantity of processing liquid to said leading edge of each of said frames;

releasably securing a residual processing liquid trap to said carrier web near the trailing edge of each of said frames;

passing said carrier web through a processing gap with an image-bearing web overlying said frames and said traps to spread the processing liquid over the area of each of said frames and onto the top surface of said trap;

transferring said traps to said image bearing web after passage thereof through said processing gap; and delivering said processed frames on said carrier web to a user.

2. The method recited in claim 1 wherein said processing liquid is supplied in rupturable pods releasably secured to said carrier web near the respective leading edges of said frames, said pods being ruptured upon passage thereof through said processing gap and thereafter transferred to said image bearing web with said traps.

3. The method recited in claim 2 wherein said pods are mounted on an apron extending across and releasably secured to said carrier web, said aprons and said pods being transferred to said image-bearing web after processing.

4. The method recited in claim 2 wherein said frames are provided by discrete image-receiving sheets secured to said carrier web in a manner to remain with said carrier web after processing and to be removed subsequently by forcible separation from said carrier web.

5. The method recited in claim 1 including the step of limiting lateral spread of processing liquid within the area of said frames lying between the side edges thereof.

6. A continuous web assembly for rapid access processing of successive image frames carried thereby by passage of said web assembly with an image bearing web through a processing gap, said web assembly comprising:

a plurality of image frames;

a continuous carrier web of a width greater than the width of said image frames to be processed;

means for locating said image frames in longitudinally spaced relation and centered transversely on said carrier web, each of said image frames having leading, trailing and side edges;

a rupturable pod for processing liquid releasably secured to said carrier web near the leading edge of each of said image frames;

a residual processing liquid trap releasably secured near the trailing edge of each of said image frames; and whereby upon processing said image frames by spread of said processing liquid over the respective areas thereof and onto said traps during passage thereof through the processing gap in contact with the image bearing web, said traps will be transferred to the image bearing web as a result of having been wetted by the residual processing liquid, such transfer being affected during separation of the image bearing web from said carrier web.

7. the continuous web assembly recited in claim 6 wherein said image frames are defined by discrete sheets secured to said carrier web.

8. The continuous web assembly recited in claim 6 wherein said liquid traps comprise strips of paper secured transversely to said carrier web by stripes of releasable adhesive.

9. The continuous web assembly recited in claim 6 wherein said pods are secured directly to said carrier web by releasable adhesive stripes.

10. The continuous web assembly recited in claim 6 wherein said pods are mounted on apron strips extending transversely across said carrier web, said apron strips being releasably secured to said carrier web by adhesive stripes.

11. The continuous web assembly recited in claim 6 further including an adhesive material located on the surface of said pods facing the image bearing web during passage through the processing gap, whereby said pods are transferred to the image web during its separation from said carrier web.

* * * * *